US009070341B2

(12) United States Patent
Ji et al.

(10) Patent No.: US 9,070,341 B2
(45) Date of Patent: Jun. 30, 2015

(54) LIQUID CRYSTAL DISPLAY DEVICE AND DRIVING METHOD THEREOF

(75) Inventors: Ha Young Ji, Gyeongsangbuk-do (KR); Jin Sung Kim, Gyeongsangbuk-do (KR); Min Ki Kim, Gyeongsangbuk-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/295,260

(22) Filed: Nov. 14, 2011

(65) Prior Publication Data

US 2012/0133635 A1 May 31, 2012

(30) Foreign Application Priority Data

Nov. 30, 2010 (KR) ..... 10-2010-0120342
Sep. 9, 2011 (KR) ..... 10-2011-0098769

(51) Int. Cl.
*G09G 3/36* (2006.01)

(52) U.S. Cl.
CPC ..... *G09G 3/3688* (2013.01); *G09G 2330/021* (2013.01)

(58) Field of Classification Search
CPC ..... G09G 3/3611; G09G 2310/0286
USPC ..... 345/212, 214, 118, 154, 117, 211, 213, 345/97–100, 55; 326/62, 63, 80; 327/333
See application file for complete search history.

(56) References Cited

U.S. PATENT DOCUMENTS 5,043,731 A * 8/1991 Nishimura ..... 341/154
5,576,738 A * 11/1996 Anwyl et al. ..... 345/212
5,926,173 A 7/1999 Moon
7,196,701 B2 * 3/2007 Tsutsui et al. ..... 345/211
7,196,710 B1 3/2007 Fouladi et al.
7,589,576 B2 * 9/2009 Itagaki ..... 327/231
7,808,468 B2 * 10/2010 Son et al. ..... 345/98
7,840,827 B2 * 11/2010 Dahan et al. ..... 713/324
8,093,543 B2 * 1/2012 Yamaoka et al. ..... 250/214 R (Continued)

FOREIGN PATENT DOCUMENTS

CN 1348167 A 5/2002
CN 1609942 A 4/2005

(Continued)

OTHER PUBLICATIONS

The First Office Action dated Apr. 14, 2014, from the Taiwan Patent Office in counterpart Taiwanese application No. 100141679.

(Continued)

*Primary Examiner* — Ram Mistry
(74) *Attorney, Agent, or Firm* — Morgan, Lewis & Bockius LLP

(57) ABSTRACT

An LCD device and a driving method thereof are disclosed. The LCD device includes a data driver, a detection unit, and a power mode control option generation unit. The data driver controls a consumption power of an output buffer which outputs an image data signal to a liquid crystal display panel. The detection unit detects a low power driving mode interval for driving the data driver at a first consumption power. The power mode control option generation unit transfers a second power mode control option to the data driver during an interval other than the low power driving mode interval, and transfers a first power mode control option to the data driver during the low power driving mode interval.

20 Claims, 5 Drawing Sheets

(56) References Cited

U.S. PATENT DOCUMENTS

| | | | | |
|---|---|---|---|---|
| 2002/0039090 | A1 | 4/2002 | Saito et al. | |
| 2004/0263461 | A1 | 12/2004 | Park | |
| 2005/0083280 | A1 | 4/2005 | Hiraki et al. | |
| 2006/0262059 | A1* | 11/2006 | Hashimoto et al. | 345/89 |
| 2008/0001886 | A1 | 1/2008 | Kim et al. | |
| 2010/0289945 | A1* | 11/2010 | Kobayashi et al. | 348/441 |
| 2011/0102411 | A1* | 5/2011 | Chang et al. | 345/212 |

FOREIGN PATENT DOCUMENTS

| | | | |
|---|---|---|---|
| CN | 1731497 | A | 2/2006 |
| CN | 1870119 | A | 11/2006 |
| CN | 1928977 | A | 3/2007 |
| CN | 101887303 | A | 11/2010 |
| JP | 06-088955 | | 3/1994 |
| TW | 406254 | B | 9/2000 |
| TW | 200632842 | | 9/2006 |
| TW | 200641780 | | 12/2006 |
| TW | 200735003 | | 9/2007 |

OTHER PUBLICATIONS

The First Office Action dated Jan. 6, 2014 from the State Intellectual Property Office of the People's Republic of China in counterpart Chinese application No. 201110402314.0.

The Second Office Action dated Aug. 27, 2014, from the the State Intellectual Property Office of the People's Republic of China in counterpart Chinese application No. 201110402314.0.

The Third Office Action dated Feb. 25, 2015, from the The State Intellectual Property Office of the People's Republic of China in counterpart Chinese application No. 201110402314.0.

* cited by examiner

LIQUID CRYSTAL DISPLAY DEVICE AND DRIVING METHOD THEREOF

CROSS REFERENCE TO RELATED APPLICATIONS

This application claims the benefit of the Korean Patent Application No. 10-2010-0120342 filed on Nov. 30, 2010 and the Korean Patent Application No. 10-2011-0098769 filed on Sep. 9, 2011, which are hereby incorporated by reference for all purposes as if fully set forth herein.

BACKGROUND OF THE INVENTION

1. Field of the Invention

The present invention relates to a Liquid Crystal Display (LCD) device and a driving method thereof, and more particularly, to an LCD device and a driving method thereof, which reduce the power consumption of a data driver.

2. Discussion of the Related Art

An LCD device controls the light transmittances of liquid crystal cells to display an image, according to a video signal.

FIG. 1 is an exemplary diagram illustrating an equivalent circuit of a pixel included in a liquid crystal display panel of a general liquid crystal display.

Since an active matrix type LCD device actively controls data by switching a data voltage supplied to pixels using a thin film transistor (TFT) formed per pixels as shown in FIG. 1, it can improve display quality of moving picture images. In FIG. 1, a reference numeral "Cst" denotes a storage capacitor for maintaining a data voltage charged in a pixel, a reference numeral 'D1' denotes a data line to which the data voltage is supplied, and a reference numeral 'G1' denotes a gate line to which a scan voltage is supplied.

In order to reduce direct current offset components and degradation of a liquid crystal, the aforementioned LCD device is driven at an inversion driving mode where a polarity is inverted between neighboring liquid crystal cells in a frame interval unit. However, according to the inversion driving mode, as a swing width of the data voltage supplied to data lines is increased and much current occurs in a data driver whenever a polarity of the data voltage is changed, problems occur in that a heating temperature of the data driver is increased and power consumption is increased rapidly.

Meanwhile, in order to reduce the swing width of the data voltage supplied to the data lines and reduce power consumption and the heating temperature of the data driver, a charge share control (hereinafter, referred to as "CSC") scheme based on a charge share circuit is applied to the data driver. However, the effect of the CSC fails to reach a satisfactory level. This is because that charge sharing carried out between data increases the number of transition times of the data voltage even though the CSC scheme reduces the swing width of the data voltage.

In this respect, in order to reduce power consumption and the heating temperature of the data driver, a dynamic CSC scheme has been recently suggested together with a power control (hereinafter, referred to as "PWRC") scheme. The dynamic CSC scheme reduces the number of transition times of the data voltage by carrying out charge sharing only when the polarity of the data voltage is inverted. The PWRC scheme controls the power of an output buffer of the data driving circuit.

However, although power consumption can be reduced by the aforementioned schemes, since the same power as that consumed for an active interval is consumed even for a vertical blank interval where no image is output between frames, the LCD device according to the related art has a problem in that unnecessary power consumption still occurs.

FIG. 2 is an exemplary diagram illustrating waveforms of various signals of a general LCD device.

Examples of signals input to a timing controller of the LCD device, as shown in FIG. 2, include a vertical synchronizing signal Vsync input in one frame period, a horizontal synchronizing signal Hsync (not shown) input in one line period, and a data enable signal DE displaying input of data.

After data of the last gate line of a frame are out, a vertical blank interval, to which data are not applied, generally occurs in a liquid crystal display panel for a certain time period before data of the first gate line of next frame are output. The other interval except for the vertical blank interval will be referred to as an active interval.

Meanwhile, as described above, since the LCD device of the related art drives the data driver at the same power option '001' even for the vertical blank interval where data are not output, as well as the active interval where data are output, the power is consumed unnecessarily.

In other words, according to the LCD device of the related art, if a power option of a source drive IC (source D-IC) of the data driver is powered on and set once, it continues to be output at one fixed value '001' without any change regardless of the vertical blank interval and the active interval.

Generally, considering RC resistance of the LCD device, the fixed value is set to a normal power mode or more. In this case, the same power mode as that used during output of real data is used even for the vertical blank interval where real data are not output, whereby unnecessary power consumption occurs in the LCD device.

In other words, according to the LCD device of the related art, the same source drive IC power option '001' is used regardless of the vertical blank interval and the active interval, whereby unnecessary power consumption occurs for the vertical blank interval.

To provide an additional description, once a power option has been set by the fixing of a liquid crystal display panel in a process of manufacturing an LCD device, the power option is never changed subsequently, and thus, the same power mode as that in actual outputting of data is being used even in the vertical blank interval.

That is, the data driver of the related art LCD device continuously uses a power portion that has been selected in the manufacturing process of the LCD device, irrespective of the vertical blank interval and active blank interval, and consequently power is unnecessarily consumed during the vertical blank interval.

SUMMARY OF THE INVENTION

Accordingly, the present invention is directed to an LCD device and a driving method thereof, which substantially obviate one or more problems due to limitations and disadvantages of the related art.

An aspect of the present invention is to provide an LCD device and a driving method thereof, which transfer a power mode control option, allowing a data driver to use the minimum power, to the data driver during a low power driving mode interval that is detected using a vertical blank interval where data is not outputted.

Additional advantages and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an LCD device includes: a data driver controlling a consumption power of an output buffer which outputs an image data signal to a liquid crystal display panel; a detection unit detecting a low power driving mode interval for driving the data driver at a first consumption power, by using a vertical blank interval of a vertical sync signal; and a power mode control option generation unit transferring a second power mode control option to the data driver during an interval other than the low power driving mode interval, and transferring a first power mode control option to the data driver during the low power driving mode interval, wherein the second power mode control option allows the data driver to be driven at a second consumption power, the first power mode control option allows the data driver to be driven at the first consumption power, and the first consumption power has a value less than the second consumption power, wherein the data driver controls a current value applied to the output buffer to control the consumption power, according to the first power mode control option or second power mode control option.

In another aspect of the present invention, a driving method of an LCD device includes: detecting a start point of a low power driving mode interval for driving a data driver in a low power driving mode, by using a vertical blank interval of a vertical sync signal; generating a first power mode control option for driving the data driver in the low power driving mode to transfer the first power mode control option to the data driver, when the start point of the low power driving mode interval is detected; applying, by the data driver which has received the first power mode control option, a first current to an output buffer which outputs an image data signal; detecting an end point of the low power driving mode interval for driving the data driver in a normal driving mode, by using the vertical blank interval; generating a second power mode control option for driving the data driver in the normal driving mode to transfer the second power mode control option to the data driver, when the end point of the low power driving mode interval is detected; and applying, by the data driver which has received the second power mode control option, a second current to the output buffer, wherein a first consumption power of the data driver, which is driven according to the first power mode control option, is less than a second consumption power of the data driver which is driven according to the second power mode control option.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE INVENTION

Reference will now be made in detail to the exemplary embodiments of the present invention, examples of which are illustrated in the accompanying drawings. Wherever possible, the same reference numbers will be used throughout the drawings to refer to the same or like parts.

Figure 1:
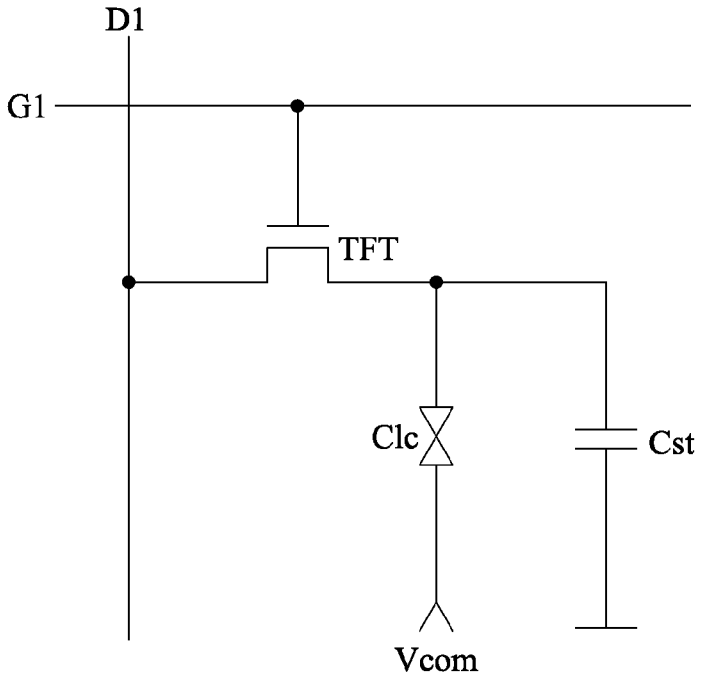
FIG. 1 is an exemplary diagram illustrating an equivalent circuit of a pixel included in a liquid crystal display panel of a general LCD device.
Figure 2:
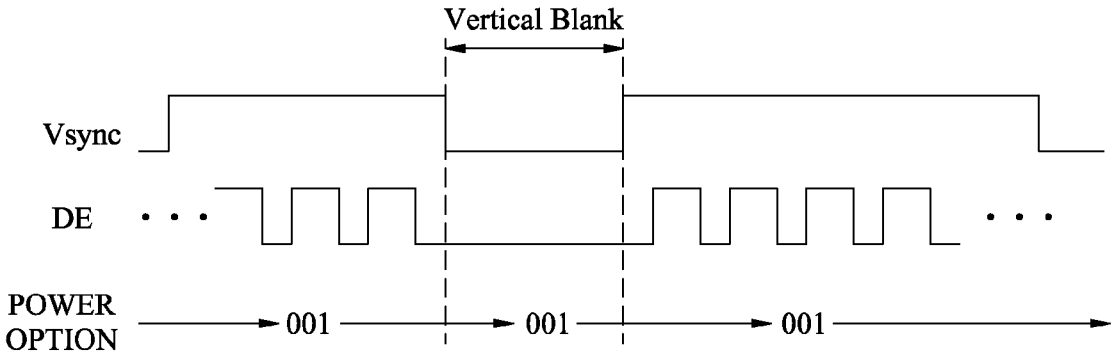
FIG. 2 is an exemplary diagram illustrating waveforms of various signals of a general LCD device.
Figure 3:
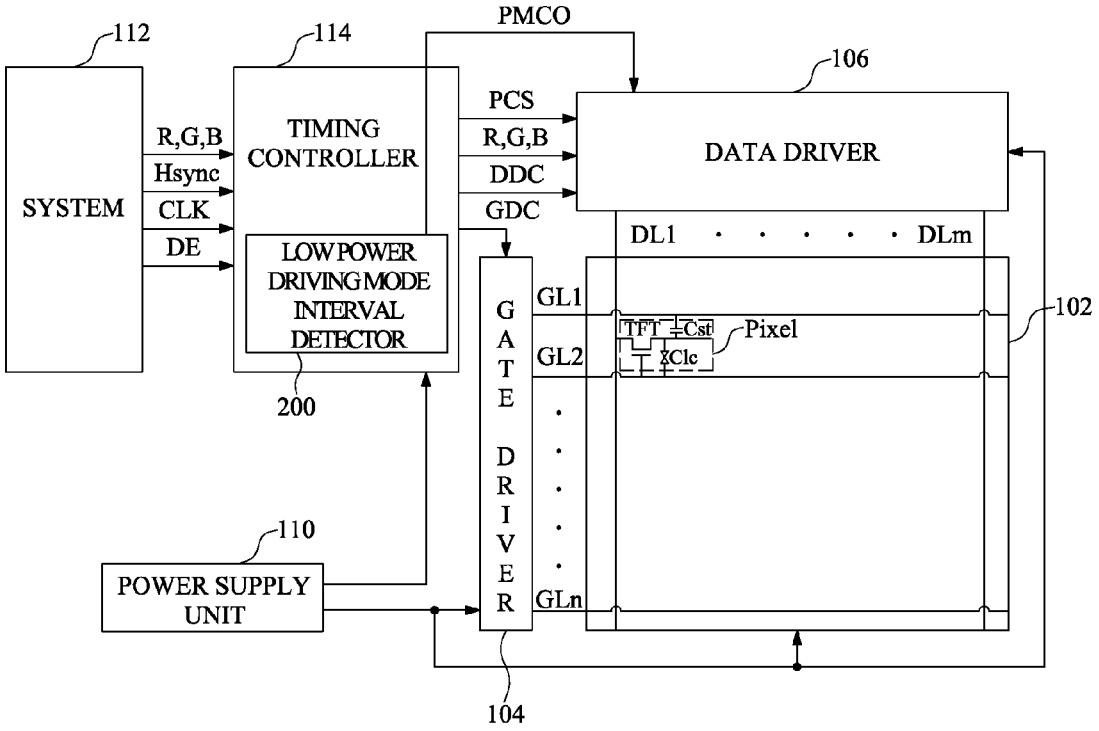
FIG. 3 is a block diagram illustrating an LCD device according to an embodiment of the present invention.

FIG. 3 is a block diagram illustrating an LCD device according to an embodiment of the present invention.

Referring to FIG. 3, The LCD device according to an embodiment of the present invention includes a liquid crystal display panel 102, a timing controller 114, a data driver 106, a power supply unit 110, and a gate driver 104.

The liquid crystal display panel 102 includes liquid crystal molecules loaded between two glass substrates. In the liquid crystal display panel 102, m×n liquid crystal cells C1*c* are arranged in a matrix arrangement by a cross-linked structure of data lines D1 to Dm and gate lines G1 to Gn.

In the lower glass substrate of the liquid crystal display panel, m data lines D1 to Dm, n gate lines G1 to Gn, TFTs, pixel electrodes of the liquid crystal cell C1*c* connected to the TFT, and a storage capacitor Cst are formed.

On the upper glass substrate of the liquid crystal display panel, a black matrix, a color filter, and a common electrode are formed. The common electrode is formed on the upper glass substrate by a vertical electric field driving mode such as a twisted nematic (TN) mode and a vertical alignment (VA) mode, and is also formed on the lower glass substrate together with the pixel electrode by a horizontal electric field driving mode such as an in plane switching (IPS) mode and a fringe field switching (FFS) mode. A polarizer is attached to each of the upper glass substrate and the lower glass substrate of the liquid crystal display panel. In this case, the polarizer of the upper glass substrate has an optical axis crossing that of the polarizer of the lower glass substrate. An alignment film is formed on the inner surface of each of the upper glass substrate and the lower glass substrate to set a pre-tilt angle of the liquid crystal, wherein the inner surface adjoins the liquid crystal.

The timing controller 114 generates control signals for controlling action timing of the data driver 106 and the gate driver 104 in accordance with a timing signal such as the vertical/horizontal sync signals Vsync and Hsync, the data enable signal, and a clock signal CLK. Examples of the control signals include a gate start pulse GSP, a gate shift clock signal GSC, a gate output enable signal GOE, a source start pulse SSP, a source sampling clock SSC, a source output enable signal SOE, and a polarity control signal POL. Also, the timing controller 114 realigns digital video data (RGB) (hereinafter, referred to as 'data') input thereto to be suitable for the liquid crystal display panel 102 and supplies the resultant data to the data driver 106.

The timing controller 114 includes a control signal generation unit (not shown) for generating the control signals, and a video data alignment unit (not shown) for realigning digital video data.

The timing controller 114 transfers a power mode control option PMCO, allowing the data driver 106 to use the minimum power, to the data driver 106 during a vertical blank interval where data is not inputted. For this end, the timing controller 114 includes a low power driving mode interval detector 200. The low power driving mode interval detector 200 will be described below in detail with reference to FIG. 5.

Figure 7:
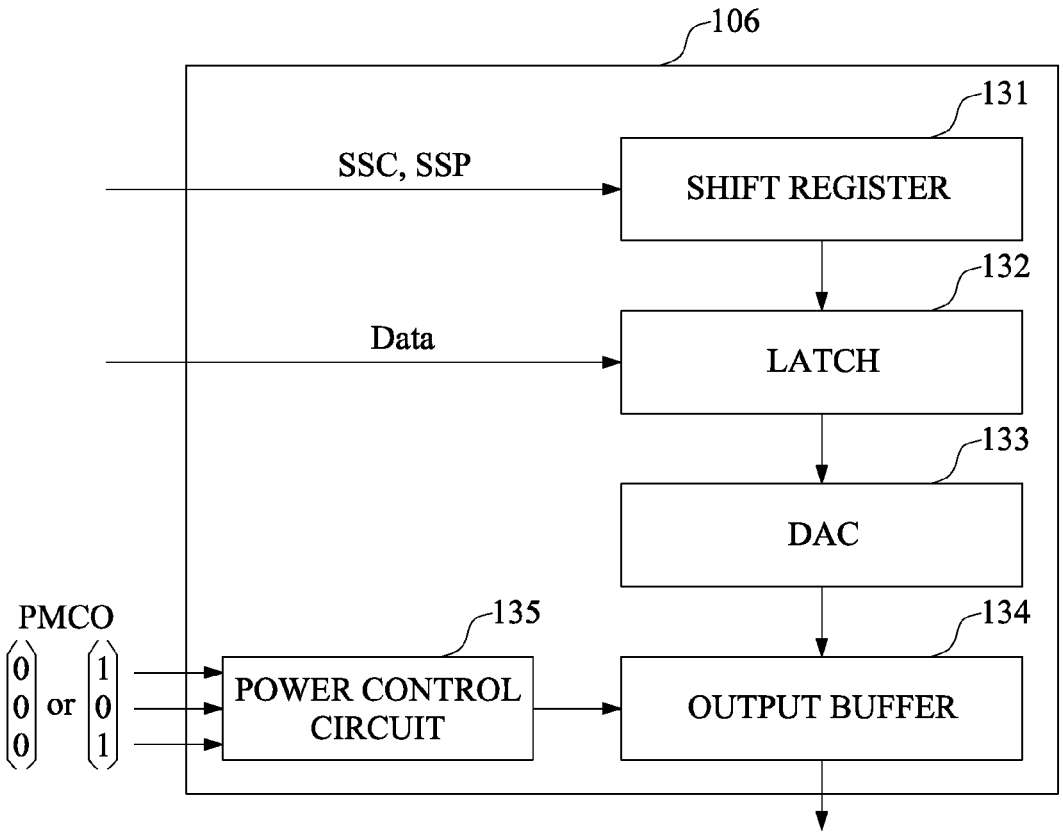
FIG. 7 is a block diagram illustrating an internal configuration of a data driver applied to an LCD device according to an embodiment of the present invention.

The data driver 106 includes a shift register, a latch, a digital-to-analog converter (DAC), an output buffer, and a power control circuit (PWRC) that are dependently connected between a plurality of input lines and the data lines DL1 to DLm (see FIG. 7). Herein, the power control circuit is switched to control the consumption power of the output buffer, according to the power mode control option transferred from the timing controller 114. In detail, the latch latches image data RGB according to the control of the timing controller 114, and the DAC converts the image data RGB into positive and negative gamma compensation voltages to generate positive and negative data voltages, which are respectively supplied to the data lines DL1 to DLm by the output buffer.

Particularly, as described above, the data driver 106 includes a power control circuit. In the power control circuit, one of a low power driving mode and normal driving mode is selected according to the power mode control option (for example, "000" or "101") transferred from the low power driving mode interval detector 200 of the timing controller 114, and the power control circuit controls the amount of a current applied to the output buffer. Accordingly, a current consumed by the output buffer varies, and thus, the total consumption power of the data driver 106 can be controlled.

In other words, during the vertical blank interval where data is not inputted, the power control circuit (PWRC) controls the power of the output buffer to moderate a data voltage rising slope from a target point according to a first power mode control option "000" transferred from the low power driving mode interval detector 200, thus decreasing power consumed by the data driver 106.

Moreover, during an active interval instead of the vertical blank interval, the power control circuit (PWRC) drives the output buffer at a normal power according to a second power mode control option "101" transferred from the low power driving mode interval detector 200.

The detailed configuration and function of the data driver 106 will be described below with reference to FIGS. 7 to 9.

Finally, the gate driver 104 includes a plurality of gate drive integrated circuits and sequentially outputs scan pulses having a pulse width of 1 horizontal period to the gate lines, wherein each of the plurality of gate drive integrated circuits includes a shift register, a level shifter for converting the output signal of the shift register to a swing width suitable for TFT driving of the liquid crystal cell, and an output buffer connected between the level shifter and the gate liens G1 to Gn.

Figure 4:
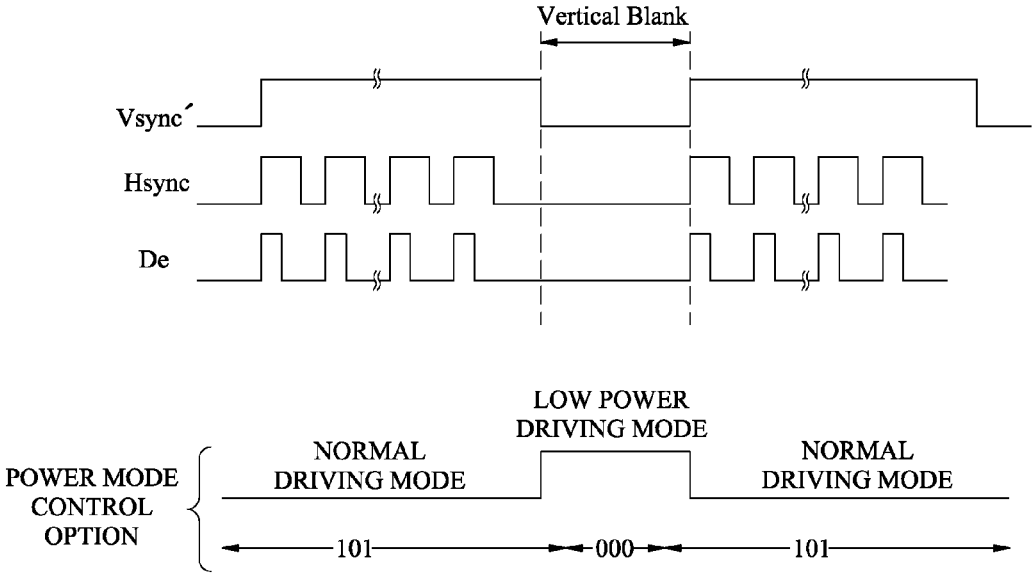
FIG. 4 is an exemplary diagram showing waveforms of various signals of an LCD device according to an embodiment of the present invention.

FIG. 4 is an exemplary diagram showing waveforms of various signals of an LCD device according to an embodiment of the present invention.

As singles inputted to the timing controller 114 of the LCD device according to an embodiment of the present invention, there are a vertical sync signal Vsync that is inputted at one-frame intervals, a horizontal sync signal Hsync that is inputted at one-horizontal line intervals, and a data enable signal DE that indicates the input of data. Also, although not shown, a dot clock (DCKL) is a signal inputted to the timing controller 114.

For example, if the LCD device is driven at 60 Hz, the vertical sync signal Vsync has a frequency of 60 Hz. If the LCD device has resolution 1024*768 of XGA grade, 768 intervals exist within an interval where the vertical sync signal Vsync is at a high level, wherein the horizontal sync signal Hsync and the data enable signal DE are output at the same time for the 768 intervals.

Herein, the vertical blank interval is an interval where data are not applied to the liquid crystal display panel 102 for a certain duration, namely, until before data corresponding to the last gate line (i.e., 768th gate line) of a frame are outputted and then data corresponding to the first gate line of a next frame are outputted to the liquid crystal display panel 102, and an interval other than the vertical blank interval is the active interval.

In the below-described embodiment, the LCD device drives the data driver 106 in the low power driving mode during the low power driving mode interval that is detected using the vertical blank interval, and thus further reduces power consumed by the data driver 106 during the vertical blank interval than power consumed by the data driver 106 during the active blank, thereby decreasing the total consumption power of the LCD device.

Herein, the vertical blank interval is not limited to an interval from a falling edge point of the vertical sync signal Vsync to a rising edge point of the vertical sync signal Vsync in FIG. 4. That is, as described above, since the vertical blank interval denotes an interval where data are not applied to the liquid crystal display panel 102, the vertical blank interval may include a certain duration before the falling edge point of the vertical sync signal Vsync is started and a certain duration after the rising edge point of the vertical sync signal Vsync is started. In the following description, however, the vertical blank interval is assumed as limited to the interval of FIG. 4, for convenience of description.

Moreover, in the embodiment, the vertical blank interval is not necessarily required to be matched with the low power driving mode. For example, the low power driving mode may be within the vertical blank interval, and the low power driving mode is not necessarily required to be matched with the vertical blank interval.

In the embodiment, the low power driving mode interval is detected using the blank interval of the vertical sync signal Vsync. The vertical sync signal Vsync may be generated by the timing controller 114, or transferred from an external system to the timing controller 114.

The vertical sync signal Vsync is generally received from the external system, but the timing controller 114 may directly generate the vertical sync signal Vsync with the horizontal sync signal Hsync and data enable signal DE received from the external system.

To provide an additional description, as described above, the vertical sync signal Vsync is generally applied from the external system to the timing controller 114. However, the vertical sync signal Vsync is changed by external noise and thus can become unsuitable for the timing controller 114. Accordingly, in the embodiment, an internal vertical sync signal Vsync' may be generated with the horizontal sync signal Hsync and data enable signal DE, and the data driver 106 may be driven in the low power driving mode during the vertical blank interval of the internal vertical sync signal Vsync'. That is, in the embodiment, the internal vertical sync signal Vsync' directly generated by the timing controller 114 may be used for more accurate timing control.

Hereinafter, a vertical sync signal generated by the timing controller 114 is referred to as an internal vertical sync signal, a vertical sync signal transferred from the external system to the timing controller 114 is referred to as an external vertical sync signal, and the collective name for the internal vertical sync signal and external vertical sync signal is referred to as a vertical sync signal.

Moreover, a method that detects the low power driving mode interval with the vertical sync signal generated by the timing controller 114 will be described below as a first embodiment, and a method that detects the low power driving mode interval with the vertical sync signal transferred from the external system will be described below as a second embodiment.

Therefore, the vertical sync signals respectively applied to the first and second embodiments will be first described below.

In the first embodiment, the timing controller 114 defines the vertical blank interval and active interval, and directly generates the internal vertical sync signal. The timing controller 114 is required to first know the start point of the vertical blank interval of the internal vertical sync signal, for directly generating the internal vertical sync signal. That is, since the timing controller 114 may determine the input time of the data enable signal as the start point of the vertical blank interval of the internal vertical sync signal, it is an important issue to detect the start point of the vertical blank interval that is continued after the active blank.

A first method where the timing controller 114 detects the start point of the vertical blank interval of the internal vertical sync signal Vsync' is as follows.

When the data enable signal is inputted from the external system, this is determined as the start point of the active blank of the internal vertical sync signal by the timing controller 114, and thus, as shown in FIG. 4, the timing controller 114 outputs a high level of internal vertical sync signal Vsync'. When the LCD device according to the embodiment is assumed as having XGA-level resolution of 2048*1080 pixels, 768 horizontal sync signals Hsync and data enable signals DE are outputted from the start point of the active interval. This duration is defined as the active interval.

The horizontal sync signal Hsync is changed to a falling edge, and thereafter when the data enable signal DE is not changed to a rising edge or the horizontal sync signal Hsync is not changed to a rising edge for a predetermined duration, the timing controller 114 determines a current time as the end of one frame to output the internal vertical sync signal Vsync' as a failing edge, and detects a point, where the internal vertical sync signal Vsync' is changed to a falling edge, as the start point of the vertical blank interval.

In order to specifically describe the method, it is assumed that the high level interval of the horizontal sync signal Hsync is configured with 1366 dot clocks, the low level interval of the horizontal sync signal Hsync is configured with about 200 to 300 dot clocks, and the data enable signal DE is set to be outputted after the horizontal sync signal Hsync is changed to a low level and then a dot clock corresponding to one-half of the high level interval of the horizontal sync signal, namely, within 1366/2 dot clocks.

In this case, when the data enable signal DE is not changed to a rising edge even after dot clocks equal to the assumed numbers are outputted, the timing controller 114 respectively determines the output horizontal sync signal Hsync and data enable signal DE as the last horizontal sync signal Hsync and data enable signal DE of a current frame, and detects a point after the dot clocks equal to the assumed numbers are outputted or a point after the time elapses, as the start point of the vertical blank interval, thereby recognizing a current interval as the vertical blank interval from the determined point.

A second method where the timing controller 114 detects the start point of the vertical blank interval of the internal vertical sync signal Vsync' is as follows.

While the horizontal sync signal Hsync and data enable signal DE are inputted and the active interval is being continued, the timing controller 114 counts the number of horizontal sync signals or data enable signals in one frame and detects a point, where a predetermined number of horizontal sync signals or data enable signals are ended, as the start point of the vertical blank interval.

If the start point of the vertical blank interval of the internal vertical sync signal Vsync' has been detected by the method, the generation of the internal vertical sync signal Vsync' is completed when the end point of the vertical blank interval is detected.

A first method where the timing controller 114 detects the end point of the vertical blank interval of the internal vertical sync signal Vsync' is as follows.

The timing controller 114 may detect a point, where the data enable signal DE or horizontal sync signal Hsync is again inputted after the start point of the vertical blank interval is detected, as the end point of the vertical blank interval.

That is, the timing controller 114 may detect a point, where the data enable signal DE or horizontal sync signal Hsync is again changed to a rising edge after the start point of the vertical blank interval, as the end point of the vertical blank interval.

A second method where the timing controller 114 detects the end point of the vertical blank interval of the internal vertical sync signal Vsync' is as follows.

The timing controller 114 may detect a point after the start point of the vertical blank interval (i.e., a point after a predetermined time) as the end point of the vertical blank interval.

If the number of dot clocks, which are outputted between the falling edge of the last horizontal sync signal Hsync or data enable signal DE of a first frame and the rising edge of the first horizontal sync signal Hsync or data enable signal DE of a second frame, is set in advance, the timing controller 114 may detect a point after dot clocks equal to the predetermined numbers are outputted, as the end point of the vertical blank interval.

The timing controller 114 defines the vertical blank interval according to the two methods of detecting the start time of the vertical blank interval and the two methods of detecting the end point of the vertical blank interval, thereby generating the internal vertical sync signal Vsync'. When combining the methods, total four methods of generating the internal vertical sync signal Vsync' may be provided.

According to the methods, the timing controller 114 may recognize an interval from the start point of the vertical blank interval to the end point of the vertical blank interval as the vertical blank interval, and recognize an interval from the end point of the vertical blank interval to the start point of the vertical blank interval as the active interval.

In addition, the timing controller 114 may generate the internal vertical sync signal Vsync' in other methods.

The above-described operations of generating the internal vertical sync signal Vsync' may be performed in the control signal generation unit of the timing controller 114, performed in a separate element that is included in a stage previous to the control signal generation unit, or performed in the below-described low power driving mode detector.

In the second embodiment, the timing controller 114 does not separately generate the internal vertical sync signal Vsync' but uses the vertical sync signal Vsync received from the external system.

In the first embodiment, the timing controller 114 defines the vertical blank interval with the data enable signal DE and horizontal sync signal Hsync received from the external system, thereby directly generating the internal vertical sync signal Vsync'. In the second embodiment, however, the vertical sync signal Vsync received from the external system is being used for detecting the low power driving mode interval.

In the second embodiment, therefore, since a pre-generated vertical sync signal Vsync is being used, the vertical blank interval is not required to be separately defined as in the first embodiment, and thus, various methods are required for setting the low power driving mode interval within the vertical blank interval.

The following description will be made on a method that detects a low power driving mode interval or a normal driving mode interval by using an internal vertical sync signal (the first embodiment) or an external vertical sync signal (the second embodiment) and then generates a power mode control option according to each mode.

Figure 5:
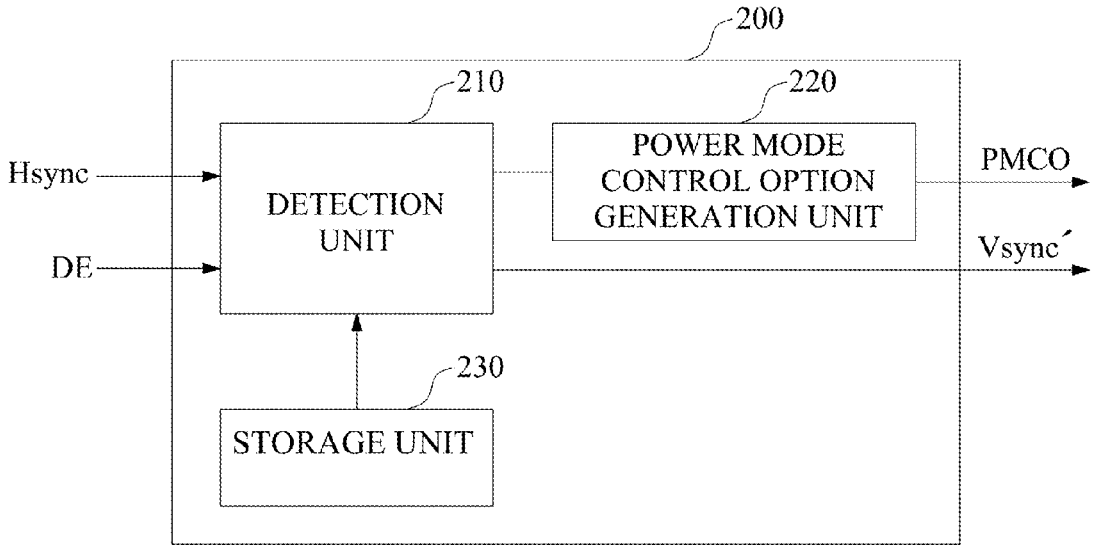
FIG. 5 is a block diagram illustrating a detailed configuration of a low power driving mode interval detector applied to a timing controller according to the present invention.
Figure 6:
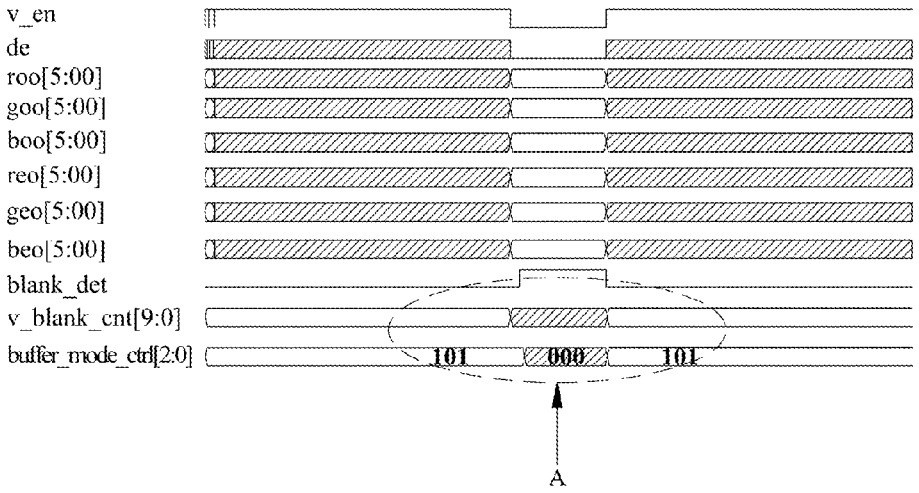
FIG. 6 is an exemplary diagram showing waveforms in a power mode control option which is outputted from a timing controller according to an embodiment of the present invention.

FIG. 5 is a block diagram illustrating a detailed configuration of a low power driving mode interval detector applied to a timing controller according to the present invention. FIG. 6 is an exemplary diagram showing waveforms in a power mode control option which is outputted from a timing controller according to an embodiment of the present invention.

Hereinafter, a method where the timing controller 114 outputs the power mode control option will be described in detail. Also, a method where the data driver 106 is driven in the low power driving mode or normal driving mode according to the power mode control option PMCO outputted from the timing controller 114 will be described below with reference to FIGS. 7 to 9.

FIG. 5 illustrates the configuration of the low power driving mode interval detector 200 according to the first embodiment that has been described above with reference to FIG. 4. Hereinafter, therefore, the configuration and function of the low power driving mode interval detector 200 according to the first embodiment will be first described with reference to FIGS. 5 and 6, and thereafter the detailed configuration and function of a low power driving mode interval detector according to a second embodiment will be described.

Referring to FIG. 5, the vertical blank interval detector 200 of the timing controller 114 includes a detection unit 210, a power mode control option generation unit 220, and a storage unit 230.

The detection unit 210 detects the start point and end point of the low power driving mode interval, and receives the horizontal sync signal Hsync and data enable signal DE from the external system.

The storage unit 230 stores information for detecting the start point and end point of the low power driving mode interval. Accordingly, the detection unit 210 detects the start point and end point of the low power driving mode interval according to the information stored in the storage unit 230.

When the power mode control option generation unit 220 receives information indicating that the detection unit 210 has detected the start point of the low power driving mode interval, the power mode control option generation unit 220 generates the first power mode control option "000" as a power mode control option for driving the data driver 106 in the low power driving mode and transfers the first power mode control option "000" to the data driver 106. When the power mode control option generation unit 220 receives information indicating that the detection unit 210 has detected the end point of the low power driving mode interval, the power mode control option generation unit 220 generates the second power mode control option "101" as a power mode control option for driving the data driver 106 in the normal driving mode and transfers the second power mode control option "101" to the data driver 106.

In the low power driving mode interval detector 200, the detection unit 210 may detect the start point and end point of the vertical blank interval to generate the internal vertical sync signal Vsync', and detect both the start point and end point of the vertical blank interval and the start point and end point of the low power driving mode interval, in the method according to the first embodiment that has been described above with reference to FIG. 4. In various methods other than the method, the detection unit 210 may detect the start point and end point of the low power driving mode interval.

The following description will be made on a method where the detection unit 210 detects the start point of the low power driving mode.

First, when the horizontal sync signal Hsync that is outputted during the active interval is changed to a falling edge and then the data enable signal DE is not changed to a rising edge for a predetermined duration or the horizontal sync signal Hsync is not changed to a rising edge, the detection unit 210 may define a start point after the predetermined duration as the start point of the vertical blank interval and detect the start point of the vertical blank interval as the start point of the low power driving mode interval.

Second, while the horizontal sync signal Hsync and data enable signal DE are inputted and the active interval is being continued, the detection unit 210 may count the number of horizontal sync signals or data enable signals in one frame to define a point, where a predetermined number of horizontal sync signals or data enable signals are ended, as the start point of the vertical blank interval and detect the start point of the vertical blank interval as the start point of the low power driving mode interval.

Third, the detection unit 210 may detect a point after a predetermined time elapses from the start point of the vertical blank interval defined by the first and second methods of detecting the start point of the vertical blank interval, as the start point of the low power driving mode interval. In the first and second methods, the start point of the vertical blank interval is the same as that of the low power driving mode interval, but in the third method, the start point of the low power driving mode interval lags behind that of the vertical blank interval.

When data and the power mode control option are changed simultaneously, since the data output of the data driver 106 is dependent on the sudden change of power, the LCD device according to the embodiment may set the start point of the low power driving mode interval after the start point of the vertical blank interval and drive the data driver 106.

Next, a method where the detection unit 210 detects the end point of the low power driving mode interval will be described below.

First, the detection unit 210 may define a point, where the horizontal sync signal Hsync or data enable signal DE is again changed to a rising edge after the start point of the vertical blank interval, as the end point of the vertical blank interval and detect the end point of the vertical blank interval as the end point of the low power driving mode interval.

Second, the detection unit 210 may define a point, where a predetermined time elapses after the start point of the vertical blank interval, as the end point of the vertical blank interval and detect the end point of the vertical blank interval as the end point of the low power driving mode interval.

Third, the detection unit 210 may detect an arbitrary point after a predetermined time elapses from the start point of the vertical blank interval defined by the methods of detecting the start point of the low power driving mode interval, as the end point of the low power driving mode interval. In the first and second methods of detecting the end point of the low power driving mode interval, the end point of the vertical blank interval is the same as that of the low power driving mode interval, but in the third method, the end point of the low power driving mode interval may lead that of the vertical blank interval.

When data and the power mode control option are changed simultaneously, since the data output of the data driver 106 is dependent on the sudden change of power, the LCD device according to the embodiment may set the end point of the low power driving mode interval after the end point of the vertical blank interval and drive the data driver 106.

In addition, the detection unit 210 may detect a point, where a predetermined time elapses after the end point of the vertical blank interval, as the end point of the low power driving mode interval. For example, in FIG. 4, the rising edge intervals of the data enable signal DE have the same width and the rising edge intervals of the horizontal sync signals Hsync have the same width. However, the rising edge interval of the internal vertical sync signal Vsync' and the rising edge interval of the data enable signal DE or horizontal sync signal Hsync are changed by another method of generating the interval vertical sync signal, and thus, when a certain time interval exists between, the rising edge interval of the internal vertical sync signal Vsync' and the rising edge interval of the data enable signal DE or horizontal sync signal Hsync, the detection unit 210 may detect a specific point of the time interval as the end point of the low power driving mode interval.

A method, where the detection unit 210 outputs the first power mode control option during the low power driving mode interval, may be variously implemented by combining the three methods of selecting the start point of the low power driving mode interval and the four methods of selecting the end point of the low power driving mode interval.

That is, eight methods may be realized by combining the three methods of selecting the start point of the low power driving mode interval and the four methods of selecting the end point of the low power driving mode interval.

Therefore, the detection unit 210 may detect the low power driving mode interval in one of the eight methods according to the method of generating the internal vertical sync signal, and thereafter output the first power mode control option "000" as a power mode control option during the low power driving mode interval, thereby allowing the data driver 106 to be driven at a low power.

However, a method where the detection unit 210 determines the low power driving mode interval is not limited to the above-described methods. Therefore, the detection unit 210 may detect the low power driving mode interval in various methods that are currently used for generating the internal vertical sync signal Vsync', and can allow the data driver 106 to be driven at a low power during the detected low power driving mode interval.

Although not shown, a low power driving mode interval detector 200 of a timing controller 114 according to a second embodiment may include a detection unit 210, a power mode control option generation unit 220, and a storage unit 230 as in FIG. 5.

However, since the timing controller 114 according to the second embodiment detects the start point and end point of the low power driving mode interval with the external vertical sync signal received from the external system, the timing controller 114 does not output the internal vertical sync signal Vsync' unlike in FIG. 5.

Therefore, the function of the detection unit 210 according to the second embodiment may differ from that of the detection unit 210 according to the first embodiment, but the function of the storage unit 230 according to the first embodiment may be the same as that of the storage unit 230 according to the second embodiment which stores various information for detecting the start point and end point of the low power driving mode interval. Also, the function of the power mode control option generation unit 220 according to the first embodiment may be the same as that of the power mode control option generation unit 220 according to the second embodiment which generates the firs power mode control option "000" or second power mode control option "101" and transfers the generated option to the data driver 106 on the basis of information transferred from the detection unit 210.

Even in the first embodiment, the internal vertical sync signal Vsync' may be generated by an element, included in the timing controller 114, instead of the detection unit 210 and transferred to the detection unit 210. In such a case, the start point and end point of the low power driving mode interval may be detected by the below-described method according to a second embodiment.

Hereinafter, various methods according to the second embodiment will be described for detecting the low power driving mode interval with the external vertical sync signal transferred from the external system. Furthermore, even in the method according to the first embodiment where the timing controller 114 generates the internal vertical sync signal Vsync', when the internal vertical sync signal Vsync' is generated in a stage previous to the detection unit 210 and inputted to the detection unit 210, the below-described method of detecting a low power driving mode interval may be applied.

A low power driving mode interval according to the second embodiment may include one of: a second low power driving mode interval (LPDM2) from the output of the data enable signal DE to a point when the external vertical sync signal Vsync is changed to a low level; a first low power driving mode interval (LPDM1) where the external vertical sync signal Vsync is maintained at a low level; and a third low power driving mode interval (LPDM3) from a point, where the external vertical sync signal Vsync is changed to a high level, to a point when data is applied to a first data line of a next frame, namely, a point when a data enable signal DE of the next frame is applied.

First, the detection unit 210 may output the first power mode control option "000" for the low power driving mode only during the first low power driving mode interval (LPDM1) in the low power driving mode interval that may be divided into the three intervals.

That is, when the detection unit 210 detects a falling edge where the external vertical sync signal Vsync is changed from a high level to a low level, the detection unit 210 generates the first power mode control option "000" for driving the data driver 106 in a low power driving mode and transfers the first power mode control option "000" to the data driver 106.

Moreover, the first power mode control option for the low power driving mode is outputted, and thereafter, when the detection unit 210 detects a rising edge where the external vertical sync signal Vsync is changed from a low level to a high level, the detection unit 210 generates the second power mode control option "101" for driving the data driver 106 in a normal driving mode and transfers the second power mode control option "101" to the data driver 106.

Second, the detection unit 210 may determines an interval, which is obtained by adding up the first low power driving mode interval (LPDM1) and second low power driving mode interval (LPDM2), as an entire low power driving mode interval, thereby driving the data driver 106 in the low power driving mode.

That is, when the output of the data enable signal DE is stopped and then a predetermined time elapses, the detector 210 generates the first power mode control option "000" for driving the data driver 106 in the low power driving mode and transfers the first power mode control option to the data driver 106.

Moreover, the detection unit 210 maintains the low power driving mode while the output of the data enable signal DE is stopped and then the external vertical sync signal is being changed from a high level to a low level, and when the detection unit 210 detects a rising edge where the external vertical sync signal Vsync is again changed from a low level to a high level, the detection unit 210 generates the second power mode control option "101" for driving the data driver 106 in the normal driving mode and transfers the second power mode control option to the data driver 106.

As described above, when the LCD device is driven at 60 Hz, the vertical sync signal Vsync has a frequency of 60 Hz. In this case, when the LCD device has XGA-level resolution of 1024*768, there are 768 intervals where the horizontal sync signal Hsync and data enabling signal DE are simultaneously outputted during an interval where the vertical sync signal Vsync has a high level. Since data is outputted together with the data enable signal DE, data is not outputted during an interval where the data enable signal DE is not outputted. Therefore, the detection unit 210 may determine an interval from a point (where the data enable signal DE is not outputted) to a point when the vertical sync signal Vsync is changed to a rising edge, as the low power driving mode interval and drive the data driver 106 in the low power driving mode.

Third, the detection unit 210 may determine an interval, which is obtained by adding up the first to third low power driving mode intervals (LPDM1 to LPDM3), as an entire low power driving mode interval, thereby driving the data driver 106 in the low power driving mode.

That is, when the output of the data enable signal DE is stopped and then a predetermined time elapses, the detector 210 generates the first power mode control option "000" for driving the data driver 106 in the low power driving mode and transfers the first power mode control option to the data driver 106.

Moreover, the detection unit 210 maintains the low power driving mode when the output of the data enable signal DE is stopped, and thereafter the vertical sync signal is changed from a high level to a low level and then again changed to a high level and is maintaining the high level. Subsequently, when the output of the data enable signal DE is again detected, the detection unit 210 generates the second power mode control option "101" for driving the data driver 106 in the normal driving mode and transfers the second power mode control option to the data driver 106.

As described above, since data is outputted according to the data enable signal DE, the detection unit 210 may drive the data driver 106 in the low power driving mode when the data enable signal DE is not outputted (i.e., a low level), and then detect a point (i.e., a rising edge), where the data enable signal DE is again outputted, to drive the data driver 106 in the normal driving mode.

Fourth, the detection unit 210 may determine an interval, which is obtained by adding up the first low power driving mode interval (LPDM1) and third low power driving mode interval (LPDM3), as the low power driving mode interval, thereby driving the data driver 106 in the low power driving mode.

In addition to the above-described methods, the detection unit 210 may detect the low power driving mode interval in various methods by using the characteristics of the external vertical sync signal, data enable signal, internal vertical sync, and horizontal sync signal, and drive the data driver 106 at a low power during the detected low power driving mode interval.

In the embodiments, FIG. 6 shows waveforms of various signals that include a power mode control option when the low power driving mode interval "000" is set slightly less than the vertical blank interval. In FIG. 6, a portion A indicates an interval where the low power driving mode and normal driving mode are changed. For example, when in the low power driving mode, the power mode control option may be indicated as the first power mode control option "000", and when in the normal driving mode, the power mode control option may be indicated as the second power mode control option "101".

In the embodiments, the above description has been made on the various methods of detecting the low power driving mode interval with the vertical blank interval, and the method that selects the power mode control option PMCO and transfers the selected option to the data driver 106 when detecting the low power driving mode interval.

In the above description, the low power driving mode interval detector 200 detects the low power driving mode interval by using the vertical blank interval, and transfers the power mode control option PMCO, allowing the data driver 106 to use the minimum power, to the data driver 106 during the low power driving mode interval. The LCD device according to the embodiments drives the data driver 106 in the low power driving mode or normal driving mode by using the power mode control option.

Therefore, the following description will be made with reference to FIGS. 7 to 9 on a method where the data driver 106 is driven in the low power driving mode or normal driving mode according to the power mode control option transferred from the timing controller 114.

FIG. 7 is a block diagram illustrating an internal configuration of a data driver applied to an LCD device according to an embodiment of the present invention.

Referring to FIG. 7, the data driver 106 includes: a shift register 131 that receives a source start pulse SSP and a source sampling clock SSC to supply a sequential sampling signal; a latch 132 that sequentially latches red (R), green (G) and blue (B) digital image data "Data" transferred from the timing controller 114 and simultaneously outputs the latched data in response to the sampling signal; a digital-to-analog converter (DAC) 133 that converts the RGB digital image data, received from the latch 132, into respective digital image data signals; an output buffer 134 that buffers and outputs the RGB digital image data signals transferred from the DAC 133; and a power control circuit (PWRC) 135 that is switched to control the amount of a current applied to the output buffer 134 and thus controls the consumption power of the data driver 106, according to the power mode control option PMCO transferred from the timing controller 114.

As described above with reference to FIGS. 3 to 6, the timing controller 114 detects the low power driving mode interval by using the vertical blank of the vertical sync signal, and thereafter selects the first power mode control option "000" as the power mode control option to transfer the first power mode control option to the data driver 106 during the low power driving mode interval, or selects the second power mode control option "101" as the power mode control option to transfer the second power mode control option to the data driver 106 during the normal driving mode interval.

When the first power mode control option "000" is received as the power mode control option, the power control circuit 135 receiving the power mode control option from the timing controller 114 is switched in order to minimize the amount of a current applied to the output buffer 134, thereby decreasing the total consumption power of the data driver 106. When the second power mode control option "101" is received as the power mode control option, the power control circuit 135 is switched such that a current applied to the output buffer 134 has a normal value, thereby driving the data driver 106 in the normal driving mode.

Herein, the power mode control option PMCO may be generated as a signal having various bits and inputted to the power control circuit 135. Hereinafter, however, a power mode control option configured with 3 bits such as "000" or "101" will be described as an example.

Figure 8:
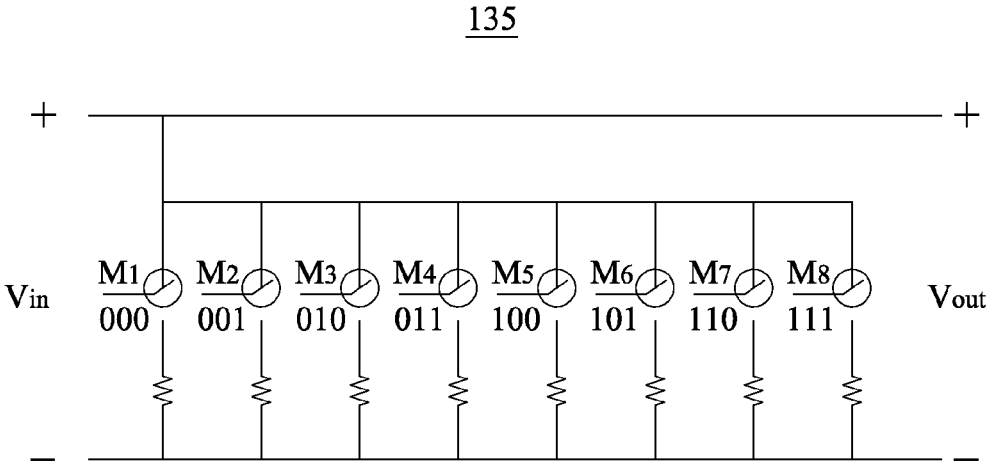
FIG. 8 is a circuit diagram schematically illustrating an internal configuration of a power control circuit of FIG. 7.

FIG. 8 is a circuit diagram schematically illustrating an internal configuration of a power control circuit of FIG. 7. FIG. 9 is a circuit diagram specifically illustrating an internal configuration of the power control circuit of FIG. 7.

First, the schematic function of the power control circuit 135 will be described below with reference to FIG. 8.

The power control circuit 135 is included in the data driver 106, for controlling the power of the output buffer 134. By controlling the amount of a current applied to the output buffer 134, the power control circuit 135 controls the consumption power of the output buffer 134.

The power control circuit 135 may be built in the data driver 106 that is configured with a plurality of data drive Integrated Circuits (ICs), or implemented as a separate IC independently from the data driver 106. In order for the power control circuit 135 to be widely applied to various types of LCD devices, the power control circuit 135 may be configured with various types of switches and output respective currents having various values.

For example, in the embodiment, the power mode control option being configured with 3 bits denotes that the power control circuit 135 is switched in $2^3$ modes (i.e., eight modes). Therefore, when the power mode control option is configured with one bit, the power control circuit 135 may be switched only in two modes (for example, the low power driving mode and the normal driving mode).

The capacity of the output buffer 134 for driving the liquid crystal display panel 102 may vary according to an RC resistance and size of the liquid crystal display panel 102 and a voltage value applied to the liquid crystal display panel 102. In order for the power control circuit 135 to be widely applied to various types of LCD devices, the power control circuit 135 may be switched in a plurality of modes. Particularly, the LCD device according to the embodiment uses a power control circuit that is switched in eight modes.

However, in the embodiment, all of the eight modes are not used in the power control circuit 135, but only two of the eight modes are used in the power control circuit 135.

In manufacturing the LCD device according to the embodiment, one mod is selected from among the eight modes, based on the RC resistance and size of the liquid crystal display panel 102 and the voltage value applied to the liquid crystal display panel 102, and the selected mode corresponds to the normal driving mode.

The normal driving mode is set to be driven when a signal having "101" is inputted as the power mode control option.

Any one of the eight modes for the power control circuit 135 is set to be matched with the low power driving mode. Herein, a mode that allows a current having the minimum value to be applied to the output buffer 134 is selected as the low power driving mode, based on the characteristic of the liquid crystal display panel 102, and the low power driving mode may be driven when the first power mode control option having "000" is received.

Accordingly, only two of the eight modes capable of being realized in the power control circuit 135 are used in the embodiment.

The function of the power control circuit 135 having the above-described features will be described below with reference to FIG. 8.

Referring to FIG. 8, the power control circuit 135 may include a plurality of resistors, and eight switches M1 to M8 respectively connected to the resistors. The switches M1 to M8 are connected to be driven according to eight different power mode control options, respectively.

To provide an additional description, since a voltage Vin applied to the power control circuit 135 is constant and a relational expression "I=V/R" is formed between a resistance and a current, a resistance value in the power control circuit 135 varies according to which of the eight switches is selected or how many switches are selected from among the eight switches.

A current applied from the power control circuit 135 to the output buffer 134 varies according to which of the eight switches is selected or how many switches are selected from among the eight switches. Accordingly, the consumption power of the output buffer 134 is changed, and thus, power consumed by the data driver 106 is changed.

Table 1 below shows examples of switches that are selected according to the value of a power mode control option configured with 3 bits.

TABLE 1

| | 000 | 001 | 010 | 011 | 100 | 101 | 110 | 111 |
|---|---|---|---|---|---|---|---|---|
| M1 | 0 | 0 | 0 | 0 | 0 | 0 | 0 | 0 |
| M2 | X | 0 | 0 | 0 | 0 | 0 | 0 | 0 |
| M3 | X | X | 0 | 0 | 0 | 0 | 0 | 0 |
| M4 | X | X | X | 0 | 0 | 0 | 0 | 0 |
| M5 | X | X | X | X | 0 | 0 | 0 | 0 |
| M6 | X | X | X | X | X | 0 | 0 | 0 |
| M7 | X | X | X | X | X | X | 0 | 0 |
| M8 | X | X | X | X | X | X | X | 0 |

In the embodiment, as seen in FIG. 8 and Table 1, the kind and number of selected switches M are changed according to the power mode control option, and thus, total resistance values in the power control circuit 135 vary. When a resistance value in the power control circuit 135 varies, a current outputted from the power control circuit 135 varies, and the consumption power of the output buffer 134 is changed.

In the above-described embodiment, a driving mode, where the output buffer 134 is driven with a current outputted from the power control circuit 135 when the power mode control option is the first power mode control option "000", is called the low power driving mode. A driving mode, where the output buffer 134 is driven with a current outputted from the power control circuit 135 when the power mode control option is the second power mode control option "101", is called the normal driving mode.

Accordingly, in the low power driving mode having the power mode control option of "000", only the first switch M1 is turned on, and a current value outputted from the power control circuit 135 is determined according to a resistance value of a resistor connected to the first switch M1, thereby allowing the output buffer 134 to be driven at the minimum consumption power (first consumption power).

A first resistance value, determined by the first switch M1 that is turned on when the power mode control option is "000", is a resistance value that enables the output of a first current necessary for driving the liquid crystal display panel 102 in the low power driving mode. The first resistance value is selected based on various characteristics of the liquid crystal display panel 102 in manufacturing the LCD device.

In the normal driving mode having the power mode control option of "101", the first to sixth switches M1 to M6 are turned on, and a current value outputted from the power control circuit 135 is determined according to resistance values of respective resistors connected to the first to sixth switches M1 to M6, thereby allowing the output buffer 134 to be driven at a normal consumption power (second consumption power).

A second resistance value, determined by the first to sixth switches M1 to M6 that are turned on when the power mode control option is "101", is a resistance value that enables the output of a second current necessary for driving the liquid crystal display panel 102 in a normal state, namely, the normal driving mode. The second resistance value, as in the first resistance value, is selected based on various characteristics of the liquid crystal display panel 102 in manufacturing the LCD device.

The second current, which is outputted from the power control circuit 135 to the output buffer 134 in the normal driving mode, may be set greater than the first current that is outputted from the output buffer 134 in the low power driving mode.

In the above-described embodiment, the second power mode control option "101" is selected as the power mode control option that enables the driving of at least one switch (which is selected from among the plurality of switches included in the power control circuit 135) necessary for driving the data driver 106 in the normal driving mode, and the first power mode control option "000" is selected as the power mode control option that enables the driving of at least one switch (which is selected from among the plurality of switches) necessary for driving the data driver 106 in the low power driving mode.

Herein, information on the first and second power mode control options may be stored in the power mode control option generation unit 220.

When the normal driving mode or low power driving mode is detected by the detection unit 210, the power mode control option generation unit 220 extracts a power mode control option corresponding to each mode and transfers the extracted option to the power control circuit 135.

At this point, as described above, the power control circuit 135 selects at least one switch M according to the power mode control option, and thus outputs different resistance values and current values. Accordingly, the consumption power of the data driver 106 including the output buffer 134 can be controlled by the power control circuit 135.

The circuit configuration of the power control circuit 135 illustrated in FIG. 8 is for schematically describing the principle that different resistance values are selected according to the power mode control option and thereby a current value applied to the output buffer 134 varies. In order to perform such a function, the power control circuit 135 may have various circuit configurations. As an example of the circuit configurations, the power control circuit 135 may have the circuit configuration of FIG. 9.

Figure 9:
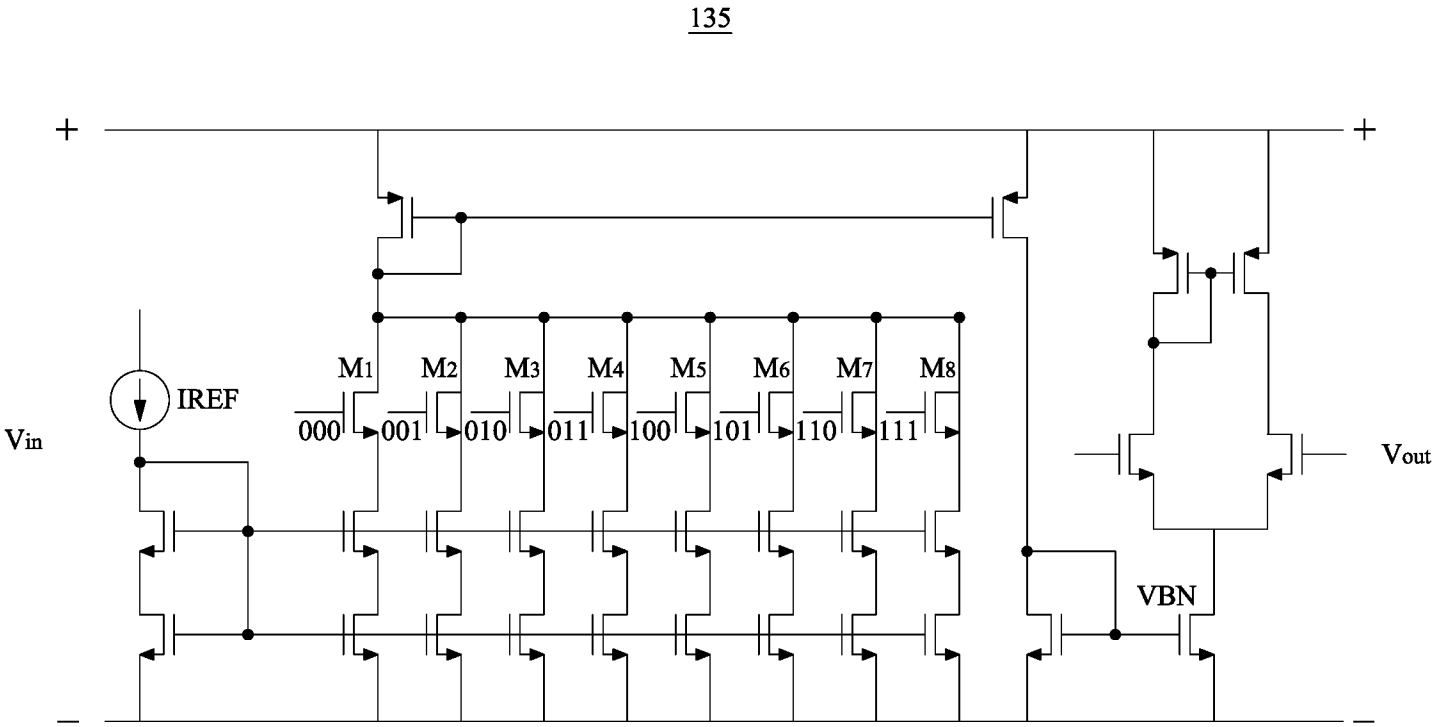
FIG. 9 is a circuit diagram specifically illustrating an internal configuration of the power control circuit of FIG. 7.

The power control circuit 135 of FIG. 9 uses respective transistors as the first to eighth switches M1 to M8 of FIG. 8, and a resistance value of a resistor connected to each transistor may be determined by other transistors. In addition to the circuit configuration of FIG. 9, the power control circuit 135 may be configured in various types by using various transistors and resistors.

Table 2 below is a comparison graph illustrating a power rate of the LCD device according to the present invention and a power rate of the LCD device of the related art.

TABLE 2

| | Sample pattern | WHITE | BLACK |
|---|---|---|---|
| Related art | 680 mA | 640 mA | 640 mA |
| Present invention | 665 mA | 626 mA | 625 mA |

In Table 2, in a state where a measurement sample is LP140WH4—FPGA (DRD Panel), V-Total: 1010 (VBI=32%), H-Total=1600, Pixel-Freq=80 MHz, current consumption of the related art (no change of SD-IC option such as buffer mode control for the vertical blank interval) is compared with current consumption per pattern according to the present invention.

It is noted from Table 2 that current consumption of the present invention is reduced at a level of 14~15 mA as compared with that of the related art. Meanwhile, when considering that sample pattern LCM current consumption is 240 mA, approximately, in ASIC of a similar condition, it is predicted that current consumption of 16% occurs.

Also, in the present invention, it is expected that current consumption will be reduced remarkably in a 3D model where a vertical blank interval occupies 32% to 64%.

In other words, the present invention is intended to minimize unnecessary current consumption of the LCD device for the vertical blank interval. To this end, the timing controller recognizes the vertical blank interval and automatically switches the power mode control option (output buffer voltage mode, charge share mode, etc.) of the data drive IC (source D-IC) to the first power mode control option "000" that can lead to minimum current consumption.

In the above description, the method that controls the consumption power of the output buffer 134 in the data driver 106 by using the power mode control option has been disclosed as an example of the embodiments, but the embodiments are not limited thereto. As another example of the embodiments, the consumption power of the data driver 106 can be controlled by controlling a charge share control circuit included in the data driver 106 according to the above-described method.

That is, the consumption power of the data driver 106 can be controlled by controlling at least one of the power control circuit 135 and charge share control circuit of the data driver 106 according to the power mode control option.

According to the embodiments of the present invention, the LCD device and driving method thereof transfer the power mode control option, allowing the data driver to use the minimum power, to the data driver during the low power driving mode interval that is detected using the vertical blank interval where data is not outputted, thus decreasing total power consumption of the LCD device.

Considering that the ASIC sample pattern consumption current of a similar spec is about 240 mA, moreover, the LCD device and driving method thereof can reduce the total consumption current of the LCD device by about 16%.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A Liquid Crystal Display (LCD) device comprising:

a data driver controlling a consumption power of an output buffer which outputs an image data signal to a data line formed in a liquid crystal display panel;

a detection unit detecting a low power driving mode interval for driving the data driver at a first consumption power during a vertical blank interval, in which no image is output, of a vertical sync signal, the vertical blank interval being generated at every time between frames; and a power mode control option generation unit transferring a second power mode control option to the data driver during an interval other than the low power driving mode interval, and transferring a first power mode control option to the data driver during the low power driving mode interval, wherein the second power mode control option allows the data driver to be driven at a second consumption power, the first power mode control option allows the data driver to be driven at the first consumption power, and the first consumption power has a value less than the second consumption power, wherein the data driver changes a resistance value according to the first power mode control option or the second power mode control option, and controls a current value applied to the output buffer by changing the resistance value to control the consumption power of the output buffer, whereby the data driver is driven at the first consumption power during the vertical blank interval and is driven at the second consumption power during the interval other than the vertical blank interval, and wherein the data driver further comprises:

the output buffer outputting the image data signal to the liquid crystal display panel; and a power control circuit switching on to select one resistance value from among at least two or more different resistance values according to the first power mode control option or second power mode control option, and outputting a current, having a value which is set according to the selected resistance value, to the output buffer, wherein the power control circuit comprises a plurality of switches equal to a number of bits of the first power mode control option or second power mode control option, wherein the resistance value is selected according to the number of switches that are selected from among the plurality of switches according to the first power mode control option or second power mode control option.

2. The LCD device of claim 1, wherein the detection unit generates the vertical sync signal with a horizontal sync signal and a data enable signal which are received from an external system, and detects a start point and end point of the low power driving mode interval in an operation of generating the vertical sync signal.

3. The LCD device of claim 2, wherein, the detection unit determines a current interval as an active interval of the vertical sync signal when the data enable signal is inputted, and the detection unit detects a point after a predetermined duration as a start point of the vertical blank interval of the vertical sync signal and the start point of the low power driving mode interval, when the horizontal sync signal is changed to a falling edge interval during the active interval and then the data enable signal is not changed to a rising edge interval for the predetermined duration.

4. The LCD device of claim 2, wherein, the detection unit determines a current interval as an active interval of the vertical sync signal when the data enable signal is inputted, and the detection unit counts the horizontal sync signal or data enable signal during the active interval to detect a point, where a predetermined number of horizontal sync signals or data enable signals are ended, as a start point of the vertical blank interval of the vertical sync signal and the start point of the low power driving mode interval.

5. The LCD device of claim 2, wherein the detection unit detects a point, which leads or lags behind a start point of the vertical blank interval of the vertical sync signal, as the start point of the low power driving mode interval.

6. The LCD device of claim 2, wherein during the vertical blank interval of the vertical sync signal, the detection unit detects a point, where the horizontal sync signal is changed to a rising edge, as an end point of the vertical blank interval of the vertical sync signal and the end point of the low power driving mode interval.

7. The LCD device of claim 2, wherein the detection unit detects a point after a predetermined time elapses from a start point of the vertical blank interval of the vertical sync signal, as an end point of the vertical blank interval of the vertical sync signal and the end point of the low power driving mode interval.

8. The LCD device of claim 2, wherein the detection unit detects a point, which leads or lags behind an end point of the vertical blank interval of the vertical sync signal, as the end point of the low power driving mode interval.

9. The LCD device of claim 1, wherein the detection unit detects a start point and end point of the low power driving mode interval with the vertical sync signal received from an external system.

10. The LCD device of claim 9, wherein the detection unit detects a point, which leads, is equal to, or lags behind a start point of the vertical blank interval of the vertical sync signal, as the start point of the low power driving mode interval.

11. The LCD device of claim 9, wherein the detection unit detects a point, which leads, is equal to, or lags behind an end point of the vertical blank interval of the vertical sync signal, as the end point of the low power driving mode interval.

12. The LCD device of claim 1, wherein, when the power control circuit receives the second power mode control option for driving the data driver in the normal driving mode, the power control circuit selects a second resistance value from among the resistance values to output a second current, generated according to the second resistance value, to the output buffer, and when the power control circuit receives the first power mode control option for driving the data driver in the low power driving mode, the power control circuit selects a first resistance value from among the resistance values to output a first current, generated according to the first resistance value, to the output buffer.

13. The LCD device of claim 1, wherein, the power control circuit is switched for first and second resistance values to be selected from among the at least two or more resistance values, the second resistance value allows the data driver to be driven in a normal driving mode, and the first resistance value allows the data driver to be driven at a consumption power less than a power which is consumed in the normal driving mode.

14. The LCD device of claim 1, wherein, the switches comprise a plurality of transistors which are switched according to the first power mode control option or second power mode control option, respectively, and the resistance values are determined according to selection of the transistors.

15. A driving method of a Liquid Crystal Display (LCD) device, the driving method comprising:

detecting a start point of a low power driving mode interval for driving a data driver in a low power driving mode, by using a vertical blank interval, in which no image is output, of a vertical sync signal, the vertical blank interval being generated at every time between frames;

generating a first power mode control option for driving the data driver in the low power driving mode to transfer the first power mode control option to the data driver, when the start point of the low power driving mode interval is detected;

changing, by the data driver which has received the first power mode control option, a resistance value according to the first power mode control option, and applying a first current generated by changing the resistance value to an output buffer which outputs an image data signal;

outputting, by the output buffer, an image data signal to a data line formed in a liquid crystal display panel by using the first current;

detecting an end point of the low power driving mode interval for driving the data driver in a normal driving mode, by using the vertical blank interval;

generating a second power mode control option for driving the data driver in the normal driving mode to transfer the second power mode control option to the data driver, when the end point of the low power driving mode interval is detected;

changing, by the data driver which has received the second power mode control option, a resistance value according to the second power mode control option, and applying a second current generated by changing the resistance value to the output buffer; and outputting, by the output buffer, an image data signal to a data line formed in the liquid crystal display panel by using the second current, wherein a first consumption power of the data driver, which is driven according to the first power mode control option, is less than a second consumption power of the data driver which is driven according to the second power mode control option, whereby the data driver is driven at the first consumption power during the vertical blank interval and is driven at the second consumption power during the interval other than the vertical blank interval, wherein the data driver comprises:

the output buffer outputting the image data signal to the liquid crystal display panel; and a power control circuit switching on to select one resistance value from among at least two or more different resistance values according to the first power mode control option or second power mode control option, and outputting a current, having a value which is set according to the selected resistance value, to the output buffer, wherein the power control circuit comprises a plurality of switches equal to a number of bits of the first power mode control option or second power mode control option, wherein the resistance value is selected according to the number of switches that are selected from among the plurality of switches according to the first power mode control option or second power mode control option.

16. The driving method of claim 15, wherein the vertical sync signal is an external vertical sync signal transferred from an external system, or is an internal vertical sync signal generated by a timing controller.

17. The driving method of claim 15, wherein a start point of the low power driving mode interval is set as a point which leads, is equal to, or lags behind a start point of the vertical blank interval.

18. The driving method of claim 15, wherein an end point of the low power driving mode interval is set as a point which leads, is equal to, or lags behind an end point of the vertical blank interval.

19. The driving method of claim 15, wherein a value of the first current is less than a value of the second current.

20. The driving method of claim 15, wherein, in the applying of a first current, the data driver, which has received the first power mode control option, selects at least one switch matched with the first power mode control option from among a plurality of switches to determine a first resistance value, and applies the first current, determined according to the first resistance value, to the output buffer, and in the applying of a second current, the data driver, which has received the second power mode control option, selects at least one switch matched with the second power mode control option from among the plurality of switches to determine a second resistance value, and applies the second current, determined according to the second resistance value, to the output buffer.

* * * * *